US005502912A

United States Patent [19]

LeBoff et al.

[11] Patent Number: 5,502,912

[45] Date of Patent: Apr. 2, 1996

[54] DISPLAY HOLDER FOR A PICTURE, CERTIFICATE, LICENSE INSPECTION STICKER, REGISTRATION STICKER AND THE LIKE

[76] Inventors: Andrew LeBoff, 6 Sycamore Ct., Seldon, N.Y. 11784-3928; John Ringel, 710 Northern Pkwy., Uniondale, N.Y. 11553

[21] Appl. No.: 220,217

[22] Filed: Mar. 30, 1994

[51] Int. Cl.[6] ..... G09F 21/04

[52] U.S. Cl. ..... 40/643; 40/593; 40/642

[58] Field of Search ..... 40/661, 642, 647, 40/643, 593, 594; 206/232; 248/461, 293, 282

[56] References Cited

U.S. PATENT DOCUMENTS

| | | | |
|---|---|---|---|
| 3,313,053 | 4/1967 | Vogeli, Sr. | 40/593 X |
| 3,533,178 | 10/1970 | Strohmaier | 40/643 |
| 4,184,276 | 1/1980 | Hernandez | 40/593 X |
| 4,270,291 | 6/1981 | Babberl | 40/594 |
| 4,524,867 | 6/1985 | Klein et al. | 40/661 X |
| 4,544,123 | 10/1985 | Peacock | 248/461 X |
| 5,025,581 | 6/1991 | Polzin | 40/594 X |
| 5,267,647 | 12/1993 | Stumpff et al. | 206/232 X |

*Primary Examiner*—Kenneth J. Dorner
*Assistant Examiner*—James O. Hansen
*Attorney, Agent, or Firm*—Michael I. Kroll

[57] ABSTRACT

A display holder for a registration sticker, inspection sticker, certificate, license, and photograph and the like is provided, which consists of a structure for protecting the display item while allowing viewing thereof. A fastener is for securing the protecting structure to a flat surface, so that a person can view the display item therefrom.

7 Claims, 1 Drawing Sheet

DISPLAY HOLDER FOR A PICTURE, CERTIFICATE, LICENSE INSPECTION STICKER, REGISTRATION STICKER AND THE LIKE

BACKGROUND OF THE INVENTION

1. Field of the Invention

The instant invention relates generally to sign devices and more specifically it relates to a display holder for a registration sticker, inspection sticker, license, picture, certificate and the like. More particularly, to a new and improved holder for an automobile registration card and the like which is adapted to be affixed to the windshield of a motor vehicle.

The present invention concerns a novel display holder that is highly efficient and easy to use and displays signs cooperative therewith, and has particular reference to a sleeve-type holder adapted to conform and adhere to a planar or gently curved supporting surface for holding and displaying signs removably inserted between the holder and the supporting surface.

The present invention relates to signs and vehicle signal devices and more particularly to a device for holding and displaying message bearing signs for viewing through the side windows of an automobile or similar vehicle. The invention further relates to a device for alternately displaying and storing one of a plurality of interchangeable cards or signs.

The present invention is related to labels which are to be adhered to a glass pane of a vehicle, more particularly on its wind-screen, for displaying data such as that evidencing the existence of insurance in force, the quality of a member with a contract of commutation in connection with a parking or garage, or other like indications.

2. Description of the Prior Art

Since the inception of the automobile, it has long been desired to display and utilize a variety of signs and signal devices in association with an automobile. Since automatic or electric turn signals were unknown in the early history of the automobile, various devices as illustrated in U.S. Pat. Nos. 1,311,408, 1,500,910, 1,445,228, and 1,232,995 were developed in order to indicate a driver's intention to turn or stop. Such devices generally utilized some type of a clamp mechanism or housing which was secured to a support frame for the automobile front windshield and from which a scissors action support arm was extended. On the end of the support was a sign which might or might not be shaped to mimic the human hand and might further include some type of reflective material or light.

These types of devices, of course, were intended to provide adequate notice and warning to fellow drivers, or other automobiles, of one driver's intention to change direction and thereby increase safety on the roads and highways. These devices were also developed in order to improve detection or visibility of turn and stop signals at a time when high wattage electrical fixtures for indicating such maneuvers were as yet undeveloped and unknown. However, these types of signaling devices perform a very limited function of indicating changes in vehicle motion and do not provide any other type of information nor for the display of printed material which may be easily read by other drivers or pedestrians.

Even after electric turn signals had become a standard accessory for most vehicles, it was still desirable to differentiate between a moving, stopping, or slowing vehicle to minimize rear end collisions. Several specialized signaling devices were developed to allow a driver to indicate his intentions to automobiles following along behind. An example of this type of device is found in U.S. Pat. No. 1,456,967 which discloses an apparatus for storing and presenting one or more signs which indicate the driver's intent to slow down or stop. This device works by storing the signs on special racks which are slidably mounted within a housing and then raised into view as the driver presses on a brake pedal. While this invention does increase operational safety factors for an automobile, it presents very limited and specific information of a driver's intentions with regards to his speed. This type of apparatus does not display any other type of alternative information or messages which a driver may wish presented to fellow drivers or pedestrians.

This type of device also cannot be readily adapted to display useful information in a cost effective manner due to its complexity and the necessity of mounting it in a fixed rearward facing location on a substantial structural portion of an automobile.

In more recent times, a variety of devices for holding vehicle registration cards, which are typically required to be in plain view in many states, have been developed. Card holders of this type are exemplified by U.S. Pat. No. 4,184,276 which discloses a specialized frame into which a registration card is placed and which is then adhesively mounted to a surface of the automobile adjacent to, or as part of, a front windshield assembly. While this type of device proves useful for the specific purpose of displaying a registration card, it does not provide an effective method of displaying any other type of message or information. It must be mounted within a very limited space to one side of the windshield in order to not block a driver's view and it does not blend well with, nor is it removable from, the overall aesthetic appearance of the vehicle.

In recent times, it has become very popular to suspend message carrying signs or sign type cards on various portions of the rear window of an automobile. This is typically accomplished using a hook attached to a suction-cup assembly with a matching hole in the sign. The signs are typically configured and printed to look like miniaturized diagonal caution signs with a variety of messages printed thereon. While this type of sign or display device has become very popular as a "fad" method of displaying various messages or derogatory comments, it has brought with it several major safety concerns.

Most notably, the suspending of one or more of these signs anywhere on a rear or front windshield has a tendency to impair the driver's visibility. Another problem with this type of sign device is the limited amount of message material that can be displayed. One sign can typically hold one message on each side, but in order to be readily viewed by the public it must be unhooked from some type of specialized holder and turned around. If a driver or passenger desires to display an alternative message, they have to remove one sign and hook another one in its place, which requires a fair amount of physical movement and motion and represents further distraction to a vehicle driver. Otherwise, if multiple messages are desired it is necessary to suspend more of them one these signs in a window which, of course, impairs a driver's vision. Due to the difficulty in reaching and changing a sign, many of these signs also tend to indicate inaccurate information such as "Child on Board" which is often not the case but which may cause problems in case of accidents.

What is desired then, is a method of presenting message type information to other vehicles or pedestrians which does not interfere with the visibility and other safety characteristics of an automobile or vehicle the message is displayed in. It is also desirable to be able to present such message information through the side windows of an automobile which is readily viewable by either passengers of other automobiles or pedestrians. It is also desirable to present a vast number of alternative messages, either pre-printed or spontaneously generated by a passenger in the vehicle, for presentation for viewing by others without the necessity of remounting signs or sign supports to portions of the vehicle.

With the advent of motor vehicles, each state in the Union developed a motor vehicle registration system which serves the dual purpose of identifying motor vehicles and providing revenues from registration fees. The universal registration system is the license plate which is secured either to the front and rear bumpers of a motor vehicle or, in some states, to the rear bumper only. Additional identification such as the registration sticker which is affixed to the inside of the windshield of the motor vehicle is required in some states. State law often provides that these identification devices be renewed yearly. Accordingly, the continued use of expired identification devices, or the absence of any identification device, indicates to the authorities that the motor vehicle is being operated illegally.

Because of their exposure on the outside of the motor vehicle, license plates must be securely fastened to the vehicle. As such, they are not readily removable. Adhesive coated registration stickers, affixed to the windshield of a motor vehicle, cannot be removed Without either mutilating or destroying the sticker. These registration identification devices are specifically designed to prevent ready and convenient removal from the motor vehicle. In the interest of deterring automobile theft and the unauthorized operation of a motor vehicle without a proper registration, it would be desirable to provide a highly visible registration card or plate that could be prominently displayed inside an automobile when the driver is present and easily removed by him when he leaves the vehicle. Apparatus suitable for this purpose, however, has not been available heretofore.

It is known in the art to provide a metal frame to be attached by brackets to the moldings on the inside of the windshield of a car into which a transparent card can be inserted. In the rear of this assembly is a device which, when activated, illuminates the transparent card. The complexity, expense and bulk of this system, however, diminishes its usefulness as a practical means of identifying motor vehicles. Moreover, because of its size and complexity, it cannot conveniently be installed by the owner.

Also, illuminated roof mounted identification signs have long been commonly used on taxicabs. While these signs often identify a taxicab by call number, their purpose is to indicate to the pedestrian whether a cab is occupied, off duty or available for hire. The use of this type of device on an automobile is prohibitively expensive and aesthetically displeasing. Moreover, such a device is permanently installed on the roof of the vehicle and cannot be readily removed by the operator when the vehicle is not being used.

Photographs are typically exhibited using one of three methods: conventional frames, low cost plastic photograph holders, or photograph albums. The advantages and disadvantages of each of these methods are discussed below.

Conventional frames are made from a variety of materials. The main parts of a conventional frame include;

1) an outer border usually made of wood, metal or plastic,
2) a transparent layer usually made of glass or plastic, and
3) an inexpensive layer of cardboard with a bracing device attached to it.

A picture is placed between the transparent layer and the cardboard layer which is then held in place within the outer border with nails or staples. The transparent material has an added benefit of protecting a picture while it is being displayed.

Conventional frames have a number of disadvantages, as follows;

1) Conventional frames are highly rigid. They can only be used to display pictures in a limited number of ways. Conventional frames can only be mounted to walls using nails or another destructive means, or propped up by a brace and exhibited on a shelf or table,
2) Conventional frames are expensive and inefficient to produce. Many frames have outer boarders made from wood or metal that must be cut and assembled by hand. Other frames use materials, such as plastics, that are specially molded to reduce the manual assembly time, however, current technology limits the cost reduction available using these types of materials.

Some manufacturers sell clear plastic photograph holders which are nothing more than a piece of clear plastic bent in the middle with a magnetic device attached to the back of the holder. While plastic holders of this type are inexpensive to produce, there are a number of disadvantages associated with this design, including:

1) the holder is rigid,
2) the holder can only be mounted to a metal surface, and
3) the holder has three open sides (photographs displayed in this type of frame can easily fall out when the frame is mounted sideways).

Photograph albums are designed to store a large number of photographs in an orderly manner. Typically, the pages in a photograph album are constructed of thin sheets of plastic that are folded or bonded in such a way that a pocket is formed in to which a photograph is inserted. Numerous pockets are housed in a single album, thereby allowing a user to view photographs by paging through the album as if the user were reading a book. Although this method of storing photographs is inexpensive, it does not provide a means of displaying photographs independent of the album. For example, there is no means of attaching an individual pocket to a wall or other surface. Display signs frequently take the form of elongated rectangular sheets having ample surface area to convey a design or message at a reasonable distance of 20 to 30 feet or beyond, such as in the case of an automobile bumper sticker or rear window sticker Such display signs typically have an adhesive coating on one side thereof for directly applying the sign itself to a supporting surface, and therefore are difficult to remove or change.

There has unquestionably existed for some long time many different holders into which signs may be inserted and removed, but as indicated by the persistence of the conventional bumper stickers and window stickers, a display sign holder having a sufficient structural integrity which is inexpensive and readily adaptable to such purposes has not yet been achieved to a sufficient degree to obtain general public acceptance.

Another type of photograph album includes plastic pockets formed in a similar manner described above. On the back side of the pocket, an adhesive layer is permanently attached to the pocket. A picture is placed into the pocket and attached to an individual page in an album by means of the adhesive layer. Examples of this type of design include, for example, U.S. Pat. No. 2,152,881 which issued on Apr. 4, 1939 to Albert W. Engel for Transparent Mounting Device; U.S. Pat. No. 2,611,369 which issued to Robert E. Herrick on Sep. 23, 1952 for Album Photo Holder or Mounting; U.S. Pat. No. 3,893,252 which issued to Martson Chase on Jul. 8, 1975 for an Adhesive Picture Mount; and U.S. Pat. No. 4,771,557 which issued on Sep. 20, 1988 to Robert G. Bowman for Transparent Pocket For Mounting Display Items And Method Of Manufacturing Same.

While photograph album pockets with an adhesive coating layered on their back side can be mounted to surfaces other than the intended page of a photograph album, all of the above described transparent pockets lack the ability to be repeatedly attached to one surface, removed at any point in time, and attached to another surface without damaging the pocket or the surface to which the pocket is attached.

In addition, pockets that permanently bond to the surface to which they are attached are limited to only holding photographs taken along a specific plane. For example, a photograph album pocket that holds a photograph in which the subject matter appears along the vertical plane can not be used at a later point in time to display a photograph in which the subject matter appears along the horizontal plane.

Still other disadvantages of these prior art pockets are apparent when they are compared to the present photograph display holder. None of the these prior art pockets can be die cut on more than two of their outer edges without damaging the underlying structure of their design. This substantially limits the ability to offer this type of design in a variety of shapes and sizes.

Still another disadvantage is that none of these prior art pockets provide an inexpensive means of providing a decorative border that overlaps the outer edges of a photograph, or special ornamental designs that enhance the subject matter of the photograph.

Numerous innovations for display holder for a picture, certificate and the like have been provided in the prior art that are described as follows. Even though these innovations may be suitable for the specific individual purposes to which they address, they differ from the present invention as hereinafter contrasted.

U.S. Pat. No. 4,184,276

Motor Vehicle Registration Card Holder

Albert Hernandez

A U-shaped holder made of a light flexible material having grooves in the inside walls and bottom thereof forming a slot to receive an automobile registration card or plate. Affixed to one face of the holder is a layer of flexible material coated with a pressure sensitive adhesive to facilitate securing the holder to the windshield of an automobile.

U.S. Pat. No. 5,025,581

Display Holder

Ellen C. Polzin

A photograph display holder is provided in which a cover with a transparent area for viewing a photograph is temporarily attached to a surface by an adhesive coating made of an impermanent adhesive material affixed to one side of the cover. A containing structure holds a photograph behind the transparent area of the cover while the cover is attached to a surface. An insertion opening allows a photograph to be removed and replaced with another photograph without removing the cover from the surface to which the cover is attached. The adhesive coating is covered by a removable layer of material. The cover is made of a pliable material. A transparent layer covers the transparent area in the cover. A protective layer of material with an adhesive coating made of an impermanent adhesive material affixed to one side of the protective layer is temporarily attached to the transparent layer. The transparent layer being made of a pliable transparent material. The cover is die cut along its outer edges and has ornamental designs placed on it.

U.S. Pat. No. 4,955,153

Display Sign Holder and Display Sign Therefor

Leonard N. Albrecht and Steven R. Burke

Disclosed is a display sign holder in the form of a semi-rigid rectangular sheet of optically clear plastic having elongated flat spacing structures extending along its top and bottom margin areas on one side so as to space the plastic sheet from a supporting surface and guide the longitudinal insertion and removal of an elongated display sign therebetween. The spacing structures are flat strips printed with ink on one or both sides to permanently display marginal information or design, and relatively thin transparent adhesive layers are disposed on both sides of the strips to adhere them to the plastic sheet and to the supporting surface.

U.S. Pat. No. 4,827,646

Vehicle Sign Display Device

Bradley J. Miller and Paul McKenna

A sign display device for use in vehicles such as automobiles comprising a variable height sign holder extendibly mounted on a housing or frame which has an attachment means for holding the display device on a vehicle door or similar structure. The variable height sign holder is a manually extendible structure preferably comprising a series of pairs of lever arms pivotally fastened together in the center on the ends to adjacent pairs so as to form a scissors action structure. An actuation handle is mounted on one end of the pairs of lever arms to move the ends closer together and extend the sign holder. A sign or card holder frame is positioned on an upper end of the pairs of lever arms for holding the signs to be displayed by, or stored in, the display device.

U.S. Pat. No. 4,695,077

Automobile Insurance Card

Roger Pretre

A label showing insurance data or the like having a transparent film attached thereto by a first adhesive layer between the label and the film, and a second adhesive layer on the opposite side of the film for attaching the combined label and film to the inner surface of a glass pane of an automotive vehicle.

Numerous innovations for display holders for a picture, certificate and the like have been provided in the prior art that are adapted to be used. Even though these innovations may be suitable for the specific individual purposes to which they address, they would not be suitable for the purposes of the present invention as heretofore described.

SUMMARY OF THE INVENTION

A primary object of the present invention is to provide a display holder for a picture, certificate and the like that will overcome the shortcomings of the prior art devices.

Another object is to provide a display holder for a picture, certificate and the like that will protect, allow viewing and secure the picture, certificate and the like to a flat surface.

An additional object is to provide a display holder for a picture, certificate and the like that will allow removal and replacement of the picture, certificate and the like when needed without having to remove the display holder form the flat surface.

A further object is to provide a display holder for a picture, certificate and the like that is simple and easy to use.

A still further object is to provide a display holder for a picture, certificate and the like that is economical in cost to manufacture.

Further objects of the invention will appear as the description proceeds.

It is an object of the present invention, accordingly, to provide a compact, inexpensive and convenient device for identifying a motor vehicle that can be easily installed on the windshield by the owner of the vehicle without appreciably diminishing the driver's visibility.

Another object of the invention is to provide a new and improved card holder that is light in weight and easy and inexpensive to manufacture.

These and other objects of the invention are attained by providing a holder composing a sturdy but lightweight and slightly flexible telescoping frame having within which a registration card or plate is adapted to be removably received. To one face of the holder is affixed a layer of flexible material coated with a pressure sensitive adhesive by means of which it may be firmly secured to the inside of a car windshield.

The present invention contemplates a registration sticker, inspection sticker, certificate, license, and photograph display holder in to which an individual registration sticker, inspection sticker, certificate, license, and photograph may be inserted. An adhesive coating made of an impermanent adhesive material is affixed to one side of the holder which allows the holder to be repeatedly attached to one surface, removed, and attached to another surface without damaging the holder or the surface to which the holder is attached. The use of an impermanent adhesive allows the user to use the holder in multiple locations over a period of time. Further, because an impermanent adhesive will not damage the surface to which it is mounted, a user is provided with significant flexibility as to the types of surfaces to which the holder may be attached. A single holder may be attached to a vehicle windshield, wooden door, plaster wall, metal refrigerator, a paper book, or virtually any other surface. Further, a single holder may be used to display a number of different stickers, certificates, registration sticker, inspection sticker, certificate, license, and photographs and the like over a period of time in which the subject matter of the displayed items appear along different planes.

It is an object of the present invention to provide a registration sticker, inspection sticker, certificate, license, and photograph display holder that can be easily attached to a variety of surfaces.

Another object of the present invention is to provide a registration sticker, inspection sticker, certificate, license, and photograph display holder that can be easily removed from one surface and attached to another surface without damaging the holder or the surface to which the holder is attached.

A further object of the present invention is to provide a registration sticker, inspection sticker, certificate, license, and photograph display holder that is less expensive to produce than the registration sticker, inspection sticker, certificate, license, and photograph holders of the prior art.

A still further object of the present invention is to provide a registration sticker, inspection sticker, certificate, license, and photograph display holder that individuals can easily use to display their personal registration sticker, inspection sticker, certificate, license, and photographs in a variety of locations.

A further object of the present invention is to provide a registration sticker, inspection sticker, certificate, license, and photograph display holder that can be easily manufactured in a variety of shapes and sizes.

A still further object of the present invention is to provide a registration sticker, inspection sticker, certificate, license, and photograph display holder which can be easily manufactured with a variety of decorative borders and ornamental designs.

Other objects and advantages of the present invention will become apparent as the description proceeds.

In accordance with the preferred embodiment of the present invention, a registration sticker, inspection sticker, certificate, license, and photographic display holder is provided. The holder includes a cover with a transparent area for viewing a registration sticker, inspection sticker, certificate, license, and photograph. An adhesive coating made of an impermanent adhesive material is provided which is affixed to one side of the cover for temporarily attaching the cover to a surface. A containing means holds a registration sticker, inspection sticker, certificate, license, and photograph behind the transparent area of the cover while the cover is attached to a surface.

In the illustrative preferred embodiment, an insertion opening allows a registration sticker, inspection sticker, certificate, license, and photograph to be removed and replaced with another registration sticker, inspection sticker, certificate, license, and photograph without removing the cover from the surface to which the cover is attached.

In the illustrative preferred embodiment, the adhesive coating is covered by a removable layer of material. The cover is made of a pliable material. A transparent layer covers the transparent area in the cover. A protective layer of material with an adhesive coating made of an impermanent adhesive material affixed to one side of the protective layer is temporarily attached to the transparent layer. The transparent layer is made of a pliable transparent material.

In accordance with the present invention, there is provided an improved display sign holder adapted to conform and adhere to a planar or gently curved supporting surface for holding and displaying signs removably inserted between the holder and the supporting surface, and which is of inexpensive construction while having significant structural integrity and adaptability to many uses.

A display sign holder constructed in accordance with the present invention includes a semi-rigid flat sheet of plastic material having at least two separate and individual compartments to display a registration sticker, inspection sticker, certificate, license, and photograph or the like a substantial thickness and an elongated rectangular configuration, with top and bottom elongated edges extending generally parallel along the length thereof and with opposite end edges extending transverse to the length thereof. Upper and lower elongated hinged bar structures are defined along the full length of the surface area margins of the sheet respectively adjacent the top and bottom edges or side of the top or sides of the bottom on the side of the display. The bar structures each have a substantial thickness, to thereby space the display and from any supporting surface against which said spacing structures are placed can be telescoped outwardly for ease in replacement of the displayed items. Each display encasement structure has a layer of adhesive extending along the exposed surface thereof, such adhesive being covered by an elongated strip of protective material which may be peeled off and discarded to expose the adhesive layers in order to adhere the holder to a supporting surface.

Further, in accordance with the preferred embodiment of the invention, the semi-rigid plastic sheet is optically clear, thereby adapting the display holder for placement on an opaque surface, such as an automobile bumper so as to hold and protect a display sign for viewing exclusively from one side thereof, and for placement on the interior or exterior of a transparent window, such as the interior or exterior of a glass automobile window, for viewing the inserted display sign from one or both sides thereof. Preferably, for maximum adaptability, the holder sheet as well as the spacing structures and adhesive layers all are of optically clear material, with the spacing structures having sufficient width to permanently display marginal information or design, which may be printed on one or both sides of the flat strips, or on one or both of the above mentioned marginal surface areas of the sheet, under an overlying adhesive layer.

With the above disadvantages and limitations of the prior art in mind, it is an object of the present invention to provide a device for displaying information through the side windows of a vehicle, such as an automobile, using a series of interchangeable message bearing cards.

It is another object of the present invention to provide a device for displaying messages or information through the side windows of a motorized vehicle which normally stores and maintains the message bearing media out of the field of view of the driver.

It is an advantage of the present invention that the information bearing media and all structural elements of the display device normally reside out of view from outside of the vehicle which also reduces field of view problems and increases vehicle safety.

It is another advantage of the present invention that it utilizes interchangeable message cards allowing simplified alteration of the displayed information with decreased distraction for the vehicle driver.

It is a purpose of the present invention to allow a device for displaying information through the side window of a motorized vehicle which provides the capability to display messages placed in the display by the device operator.

It is another purpose of the present invention to provide a device for displaying messages or information through the windows of a vehicle which is inexpensive to manufacture, lightweight, and transportable between a variety of vehicles without customization.

In a preferred embodiment, the extendible support means comprises a scissors type support frame.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

10—display holder
12—display compartment 1
14—display compartment 2
16—windshield
18—vehicle
20—passenger compartment
22—display holder frame attachment
24—inspection sticker
26—registration sticker
28—hinge-like movement
30—hinge
32—display holder fastener
34—fastening means
36—display holder frame fastener
38—scissor-like lever
40—frame hinge
42—display encasement hinge
44—display item encasement
46—scissor-like extension movement

DETAILED DESCRIPTION OF THE PREFERRED EMBODIMENT

Figure 1:
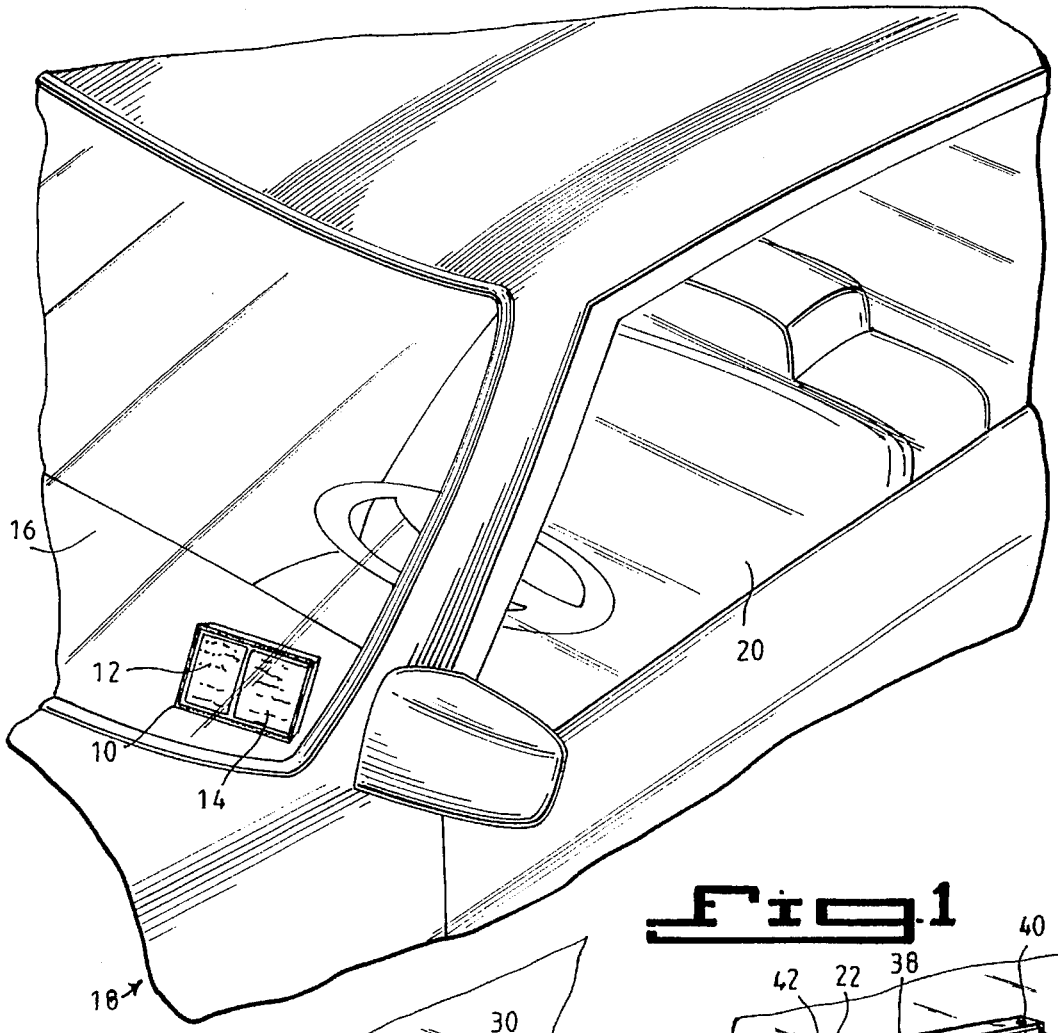
FIG. 1 is a partial perspective view of a motor vehicle with the display holder attached to an inner lower corner of a windshield.

Referring to FIG. 1 which is a partial perspective view of a motor vehicle 18 with the display holder 10 attached to an inner lower corner of a windshield 16. The display holder 10 having dual compartments 12 and 14 to display registration sticker, inspection sticker, certificate, license, and photograph within. The display holder 10 is transparent as not to interfere with a driver's view from the passenger compartment 20.

Figure 2:
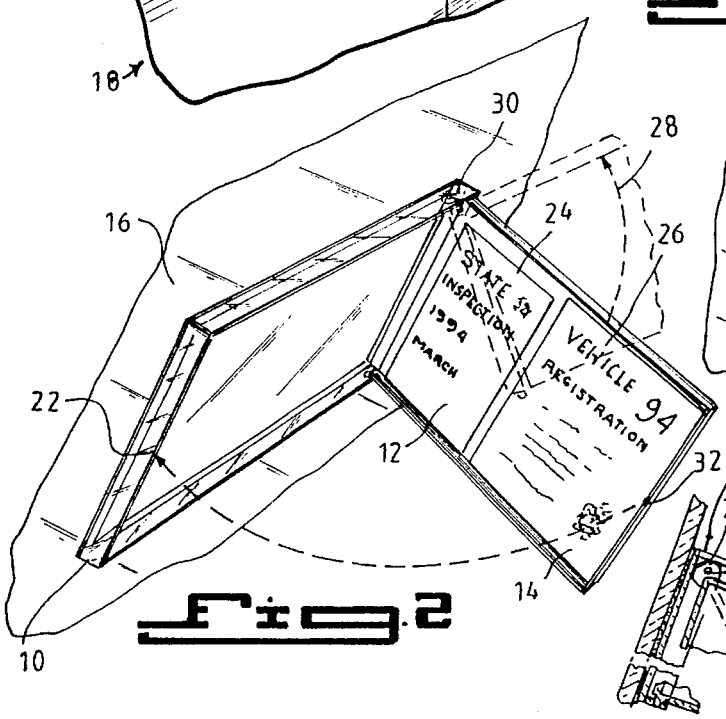
FIG. 2 is a perspective view of the instant invention showing the protective covering being opened by a hingable means.
Figure 2A:
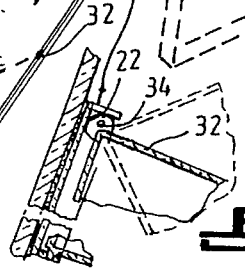
FIG. 2A is a further detailed view of the present invention.

Referring now to FIG. 2 and 2A which is a perspective view of the display holder 10 showing the dual display compartments 12 and 14 containing a registration sticker 26 in display compartment #2 14 and an inspection sticker in display compartment #1 12 being opened by a hingable means having a hinge 30 located on the display holder frame attachment 22 functioning to allow hinge-like movement 28. The hinge-like movement 28 was designed especially to function to facilitate the insertion of display items in the display holder 10. A further feature which is a display holder fastener 32 mounted on the display encasement fastens securely into the display holder frame fastener 36 by virtue of a fastening means 34 which could be readily fastened by clip, ball and socket or other means.

Figure 3:
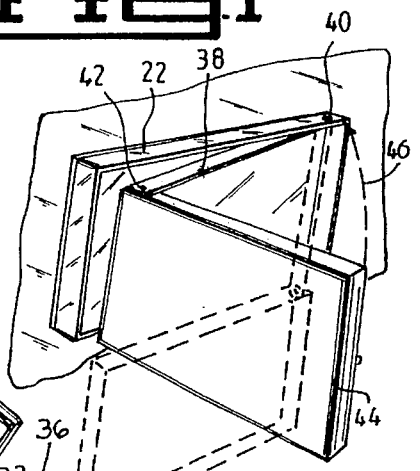
FIG. 3 is a top perspective view of the display holder showing another embodiment whereas the protective covering containing registration sticker, inspection sticker, certificate, license, and photograph encasement being extended by scissor-like extension levers.

Referring lastly to FIG. 3 which is a top perspective view of the display holder 10 showing another embodiment whereas the display item encasement 44 containing display items such as registration sticker 26, inspection sticker 24 and the like. The encasement 44 may be extended outwardly via being extended by scissor-like extension levers 38 which are hingably mounted at one end on the display holder frame 22 by virtue of a frame hinge 40 and at the other end hingably mounted on the display item encasement 44 by virtue of a display encasement hinge 42. The scissor-like extension movement 46 can be in a sideways, downward or upward direction depending upon which sides and end of the display holder frame attachment 22 the frame hinges 40 are mounted. The functionability of the scissor-like movement 46 is to facilitate the addition and removal of display items in the display holder 10 which is readily and universally adaptable to any size or angled vehicle window 16.

It will be understood that each of the elements described above, or two or more together, may also find a useful application in other types of constructions differing from the type described above.

While the invention has been illustrated and described as embodied in a display holder, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A display holder comprising;

a) at least two separate compartments to display items selected from the group consisting of registration sticker, inspection sticker, certificate, license, and photographs, said compartments being open at one end functioning to facilitate the additional and removal of display items, said compartments being manufactured from transparent colored material functioning to highlight said display items, said compartments being configured from a group of shapes consisting of round, square, rectangular, triangular and polygonal, b) at least one frame attachment containing a hingable means therein, said frame attachment having adhesive means thereon functioning to attach said display holder to a surface, c) at least one display item encasement functioning to encase and protect display items selected from the group consisting of registration sticker, inspection sticker, certificate, license, and photographs, said display item encasement having at least one hingable means, said display item encasement being manufactured from transparent colored material, and said display item encasement having a plurality of hingable means functioning to extend outwardly, inwardly, downwardly and upwardly depending upon a configuration of said surface for attachment, and d) said frame attachment and said display item encasement having fastening means therein.

2. A display holder as described in claim 1, whereas said hingable means having a pair of scissor-like levers attached at one distal end to said frame attachment and an opposite distal end attached to said display item encasement.

3. A display holder as described in claim 1, whereas said plurality of hingable means having a pair of scissor-like levers attached at one distal end to said frame attachment and an opposite distal end attached to another scissor-like lever with its opposite distal end attached to said display item encasement.

4. A display holder as described in claim 1, whereas said display holder having a fastening means therein to securely fasten said frame attachment to said display item encasement.

5. A display holder as described in claim 1, whereas said display item encasement is waterproof.

6. A display holder as described in claim 1, whereas said frame attachment being constructed from strong durable rigid material.

7. A display holder as described in claim 1, whereas said frame attachment being constructed from strong durable flexible material to conform to various angular surface arrangements.

* * * * *